US005162031A

United States Patent [19]

Watson

[11] Patent Number: 5,162,031

[45] Date of Patent: Nov. 10, 1992

[54] LIFTING SYSTEM

[75] Inventor: Douglas E. Watson, Milwaukie, Oreg.

[73] Assignee: Forrest Bennett, Gladstone, Oreg.

[21] Appl. No.: 659,831

[22] Filed: Feb. 22, 1991

[51] Int. Cl.[5] ..... A63B 21/078

[52] U.S. Cl. ..... 482/104; 482/128

[58] Field of Search ..... 272/117, 118, 122, 123, 272/134, 135, 141, 142; 211/123; 108/29; 482/93, 98, 104, 106, 108, 121, 128

[56] References Cited

U.S. PATENT DOCUMENTS

| | | | |
|---|---|---|---|
| 3,207,511 | 9/1965 | Hoffman | 272/117 X |
| 3,445,109 | 5/1969 | Kolber | 272/141 X |
| 4,155,465 | 5/1979 | Baublitz | 211/123 |
| 4,540,171 | 9/1985 | Clark et al. . | |
| 4,564,194 | 1/1986 | Dawson . | |
| 4,650,186 | 3/1987 | McCreery et al. . | |
| 4,750,739 | 6/1988 | Lange . | |
| 4,775,148 | 10/1988 | McLaughlin | 272/139 |
| 4,832,334 | 5/1989 | Mullen | 272/123 |
| 4,973,050 | 11/1990 | Santoro et al. | 272/117 |

*Primary Examiner*—Robert Bahr

*Attorney, Agent, or Firm*—Chernoff, Vilhauer, McClung & Stenzel

[57] ABSTRACT

A device for assisting a lifter during exercise with a weighted bar including a pair of upwardly-mounted brackets for enclosing respective end portions of the bar. The brackets include a lower portion defining a narrow channel which centers the bar when the bar is lowered and further include an upper outwardly flared portion permitting natural movement by the lifter when raising the bar. A resilient lift assembly mounted in the channel provides a dynamic lift-restoring force to the bar in response to downward movement of the bar thereagainst for development of explosive muscle power of the lifter. The brackets include a ramp surface inclined toward the channel for self-spotting by the lifter.

5 Claims, 4 Drawing Sheets (a)
(b)
(c)
(d)
(e)
(f)
(g)
(h)
(i)

LIFTING SYSTEM

BACKGROUND OF THE INVENTION

This invention relates to exercise devices and more particularly to weight-lifting devices for sport-specific muscle development.

There has been much interest given recently to sports-specific or "explosive" muscle development. For example, in football, a lineman uses his arm muscles to "explosively" drive back other players. Similarly, during running events, the athlete's leg muscles explosively press off against the track field. To help develop those muscles which specifically contribute to explosive power, several weight-lifting machines have been developed.

One such machine is shown in Lang, U.S. Pat. No. 4,750,739. The Lang machine is used for "squat" type exercises where the lifter carries a barbell behind his back at shoulder level and repetitively performs "squats" by bending and straightening both of his knees. In Lang, pneumatically-driven pistons are attached to either end of the barbell and add a supplemental load to the barbell as the lifter squats. At the bottom of the squat, the chambers in the pistons are depressurized causing abrupt removal of the supplemental load so that the lifter explodes upward in reaction. A machine operating under similar principles is found in Clark et al. U.S. Pat. No. 3,540,171. In Clark, weighted platforms are moved onto or off of respective end portions of the barbell.

In both Clark et al. and Lang, the supplemental load is added to the weighted bar while the lifter's muscles experience increased bending or lengthening (eccentric contraction) and then the load is suddenly removed just before the lifter's muscles experience increased straightening or shortening (concentric contraction). Such differential loading as depending on muscle activity has been found beneficial in developing sports-specific "explosive" muscle power.

These and similar weight-lifting machines, however, have heretofore been expensive to make, difficult to operate, and carry a high potential for injury. In particular, the individual lifter must decide not only how much weight should go on the barbell but also how much supplemental load should be added, over what range the supplemental load should act, and how to configure the specific machine being used to establish these load levels and ranges. A mistaken choice by the lifter can result in the lifter being jerked downwardly underneath a load he can neither support nor manage and cause tearing of the lifter's muscles or injury to his back or chest region.

The severe injuries that have occurred with these or other types of weight-lifting devices have spurred the development of "self-spotting" devices. The purpose of these devices is to prevent the lifter from becoming pinned or crushed under a heavy weight and are designed to be activated by the lifter himself, during the exercise, without outside intervention. Existing self-spotting devices, however, do not adapt well to weight-lifting machines which develop sports-specific explosive muscle power.

In some machines, for example, travel of the barbell is artificially restricted along a linear path of travel adjacent a guide rail. This approach, for example, is shown in Dawson U.S. Pat. No. 4,564,194, where a barbell carrying hooklike pins is guided along two vertical struts which have a series of holes formed along their length. To stop the barbell during the exercise, the lifter rotates the bar so that the pins hook into the holes on the struts. This setup, however, would restrict natural muscle movement during exercises such as squats, where the bar is carried along a forward to rearward direction as well as along a vertical direction.

An alternative type of self-spotting device is shown in McCreery et al. U.S. Pat. No. 4,650,186. The MoCreery et al. device is intended to operate durinq a bench type exercise where the lifter lies face up on a bench and maneuvers the barbell, using his arms, in repetitive movements towards and away from his chest. The lifter operates the self-spotting device by pressing his feet against a foot pedal which raises a pair of support platforms that engage either side of the barbell. With the foot pedal, the lifter can use the combined power of his arms and legs to raise the bar onto a pair of upwardly mounted support hooks. This approach, however, would not permit explosive muscle development of the lifter's legs because the lifter must keep his legs free to activate the self-spotting device. Furthermore, if the lifter should collapse from strain after the foot pedal has been activated, the barbell can fall upon and crush the lifter.

Accordingly, it is an object of the present invention to provide a weight-lifting device for developing sports-specific "explosive" muscle power which is inexpensive to make and simple to operate.

A further object of the present invention is to provide a weight-lifting device having a self-spotting device which is compatible with free maneuverability of the weights by the lifter and which will protect the lifter against injury even if the lifter collapses from fatigue.

SUMMARY OF THE INVENTION

In the present invention, the respective end portions of a weighted bar, such as a barbell, are passed through a spaced-apart pair of upwardly mounted brackets. These brackets include a lower support portion which defines a narrow channel so that when the bar is lowered by the lifter it will be centered along a particular direction. The brackets further include an upper outwardly flared loop portion which permits limited horizontal and vertical movement of the bar so that when the bar is raised by the lifter it can travel in accordance with natural muscle movement but cannot inadvertently swing beyond predetermined safe limits.

Preferably, an inclined ramp portion is positioned between the upper loop portion and the lower support portion so that the lifter can guide the weighted bar along the ramp and into the channel.

In another aspect of the present invention, a resilient lift assembly is mounted within the channel defined by the lower support portion of the bracket. As the lifter guides the weighted bar downward, the weighted bar presses against this resilient lift assembly, causing the assembly to generate a dynamic lift-restoring force. This dynamic lift-restoring force augments the force applied to the weighted bar by the lifter himself and causes the weighted bar to rebound against the lift assembly thereby developing the explosive muscle power of the lifter.

Preferably, the receiving end of the resilient lift assembly is separated from the weighted bar after the weighted bar rebounds so that the weighted bar is entirely under the guidance of the lifter during some portion of the exercise.

The foregoing and other objectives, features and advantages of the invention will be more readily understood upon consideration of the following detailed description of the invention, taken in conjunction with the accompanying drawings.

FIG. *2a* is a sectional view of a preferred resilient lift assembly for the exemplary exercise device.

FIG. *2b* is a sectional view taken along line *2b—2b* of FIG. *2a*.

FIG. *2c* is a sectional view, similar to FIG. *2b*, but after the upper cylinder of the lift assembly has been turned along the direction indicated in FIG. *2b*.

FIGS. *3a–3c* are schematic depictions of a lifter, on a conventional bench, using the exemplary exercise device for a bench-press type exercise.

FIGS. *4a–4i* are schematic depictions of the movement of the weighted bar in the region near the preferred resilient lift assembly and of the interaction occurring between the resilient lift assembly and the weighted bar.

FIGS. *5a–5c* are schematic depictions of a lifter using the exemplary exercise device for a squatting type exercise. FIGS. *6a–6d* schematically depict use of the ramp surface of the preferred bracket configuration for self-spotting.

Figure 7:
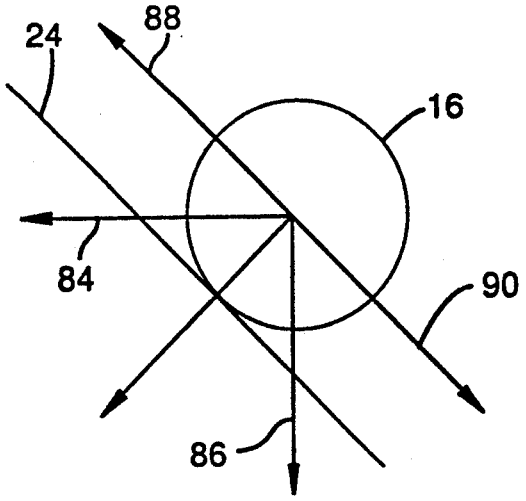

FIG. 7 schematically depicts the component forces acting on the weighted bar during self-spotting by the lifter.

DESCRIPTION OF THE PREFERRED EMBODIMENT

Figure 1:
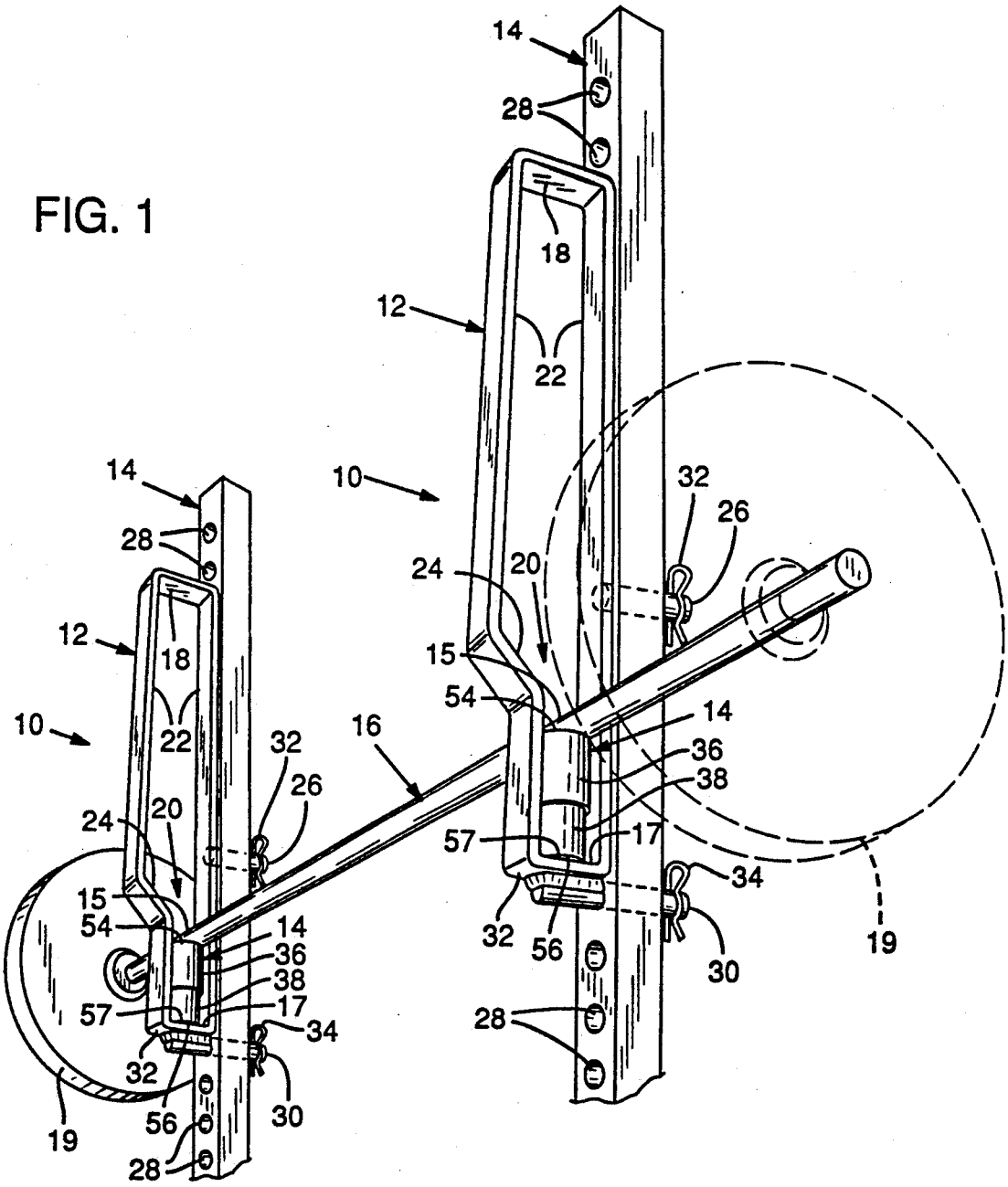
FIG. 1 is a perspective view of the left-hand and right-hand members of an exemplary exercise device in accordance with the present invention, supporting a conventional barbell.

FIG. 1 shows the left-hand and right-hand members 10 of an exemplary exercise device constructed in accordance with the present invention for sport-specific muscle development. Each member is mounted on a conventional load-bearing strut or support 14 of the type commonly found in rooms designed for weight-lifting equipment. Each member 10 surrounds and selectively receives, during the exercise, a respective end portion 15 of a weighted bar 16. As shown partially in phantom in FIG. 1, this weighted bar may comprise a conventional barbell having plate-like weights 19 that fit detachably on its respective ends.

Each member 10 of the exemplary exercise device includes a specially-configured bracket 12 made of a strong and rigid material. Preferably, steel is used and the bracket 12 is either casted as a single piece or bent from a long bar with the ends of the bar butt-welded together. The bracket is formed so as to include a generally U-shaped lower support portion 17 and an upper outwardly flared loop portion 18. The lower support portion 17 defines a narrow channel 20 and the upper outwardly-flared loop portion 18 includes an opposed pair of upright guide members 22 which are spaced apart by a distance wider than the narrow channel 20. Preferably included on the rearward one of the upright guide members 22 is a ramp surface 24 inclined downwardly from the member 22 toward the narrow channel 20. A mounting peg 26, also made of a suitably strong material such as steel, is preferably end-welded to the forward guide member 22. This mounting peg is appropriately dimensioned for insertion through one of the respective holes 28 which have been conventionally formed along the length of the vertical strut or support 14. A second mounting peg 30 is welded to the bottom of the bridge member 32 of the generally U-shaped lower support portion 17 and is also dimensioned for insertion into one of the respective holes 28.

Each member 10 of the exemplary exercise device further includes a resilient recoil lift assembly 14 supported on top of the bridge member 32. Referring now to FIG. *2a*, the resilient lift assembly 14 preferably is comprised of first and second casted steel, closed-ended cylinders, 36 and 38, respectively, which have been telescopically fitted together so as to define a reciprocably expandable chamber 40. Mounted within this chamber is a heavy-duty coiled spring 42, each end of which is connected to a respective cylinder by spring-engaging clips 44 and 46, respectively. Referring to FIG. *2b*, by turning one cylinder 36 relative to the other cylinder 38 along a direction 48, it is possible to slip the end portion 50 of the spring 42 out from under the spring-engaging clip 44, as shown in FIG. *2c*. The cylinder 36 will then slide telescopically off of the cylinder 38, which is similarly rotated out of engagement with the other clip 46, to permit replacement of the spring 42. Reversing the order of this procedure, it becomes possible to mount the spring within the cylinders 36 and 38 so that the spring will keep the cylinders together.

The outer closed ends of the first and second cylinders 36 and 38 define, respectively, the receiving and mounting ends, 54 and 56, of the preferred resilient lift assembly 14. Referring again to FIG. 1, the resilient lift assembly is mounted within the narrow channel 20 of the bracket by welding or otherwise attaching the mounting end 56 to the upwardly-facing surface 57 of the bridge member 32. With this arrangement, it will be recognized that compression of the coiled spring 42 between the receiving end 54 and mounting end 56 of the lift assembly opposes downward movement of the weighted bar. The term "downward" and the term "weight-directional" are used interchangeably herein to denote the direction in which the weighted bar 16 is naturally pulled by the force of gravity.

Setup of the exemplary exercise device is accomplished by mounting each bracket 12 on an upright support 14 by inserting the bracket's mounting pegs 26 and 30 into the appropriate pair of holes of the support at a height that is appropriate for the desired exercise. For bench-type exercises, for example, the bridge member 32 of the bracket 12 should extend just below the lifter's chest region, as shown in FIGS. *3a* to *3c*, while for standing and squatting exercises the bracket 12 is higher as shown in FIGS. *5a* to *5c*. Cotter pins 32 and 34 are inserted through openings (not shown) formed into the mounting pegs to keep the pegs from slipping out of the holes 28 during the exercise. The elongate rod of the weighted bar 16 is then passed through both the left-hand and right-hand brackets 12 so that each respective end portion 15 of the elongate bar is surrounded by a respective bracket 12. The plate-like weights 19 are next slipped over the end nubs of the bar 16 and secured thereto in the conventional manner. The amount of weight the lifter chooses can be the same amount or a somewhat greater amount than he would choose if he were to perform the lift without the assistance of the members 10 of the exercise device.

Figures 2A, 2B, 2C, 4:
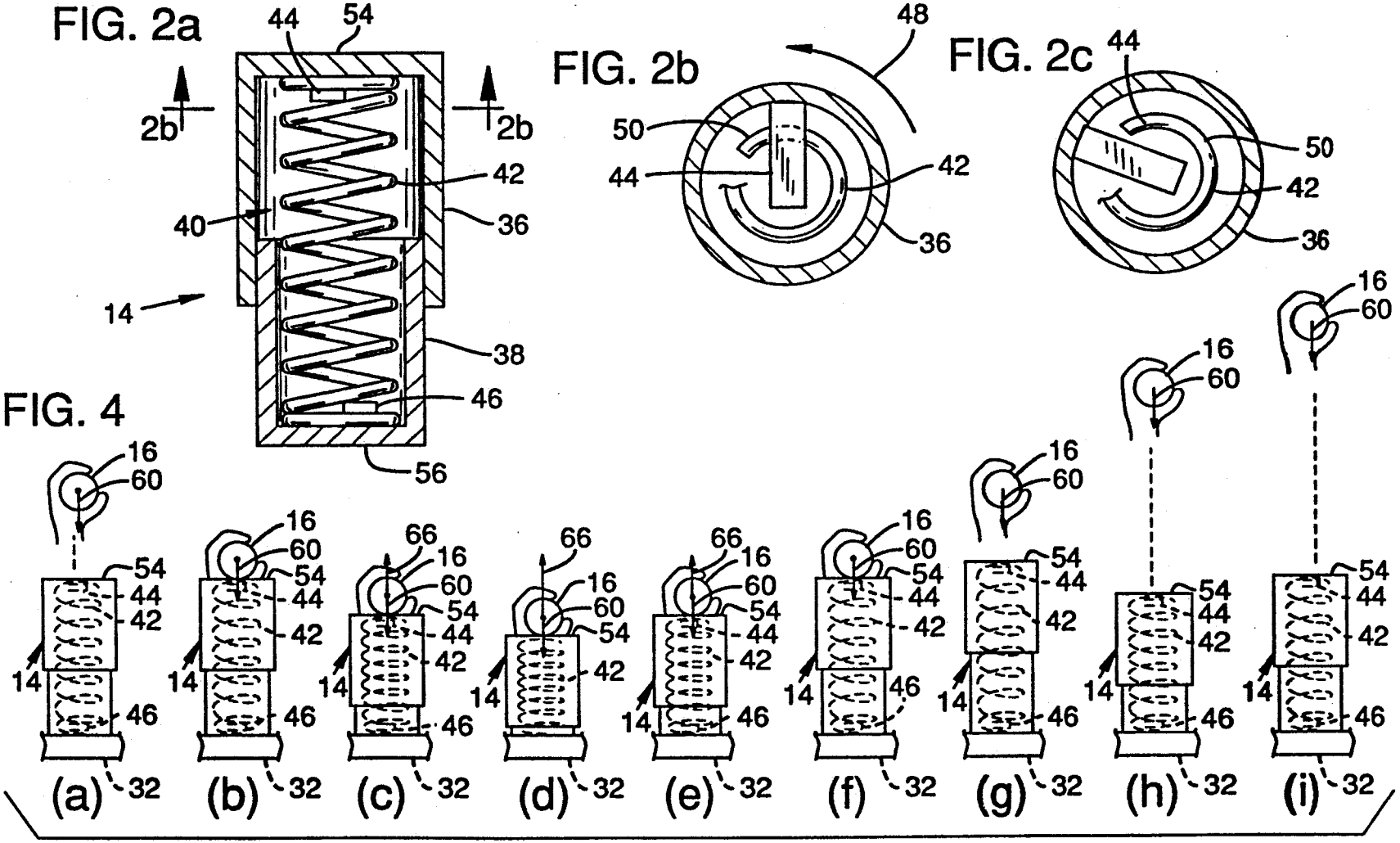
Figure 3:
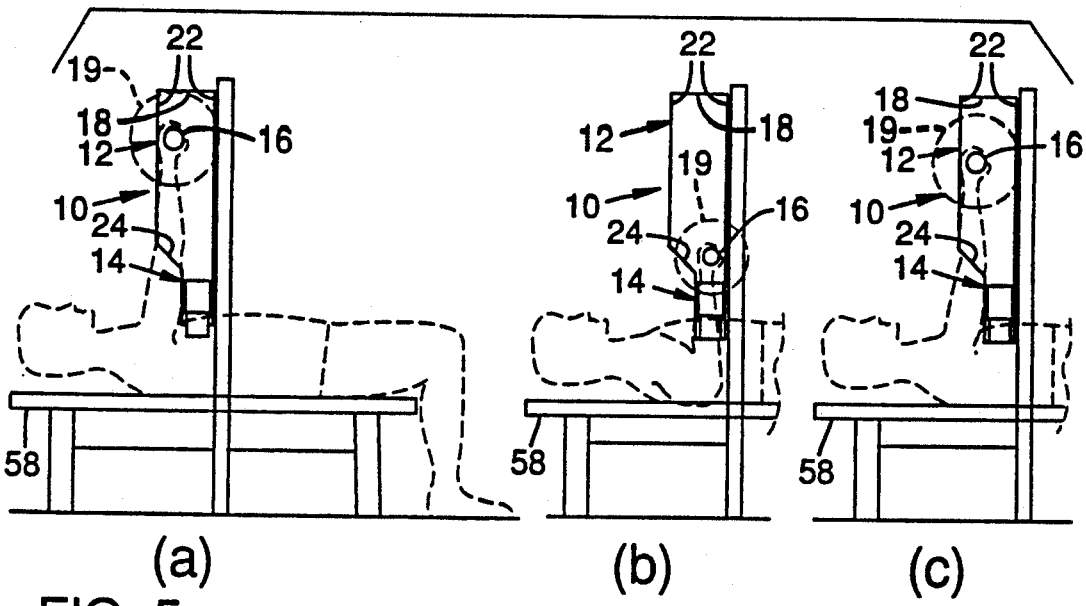

Referring now to FIG. 3*a*, positioning himself on an exercise bench 58 beneath the initial rest position of the weighted bar 16, the lifter starts the exercise by raising the bar. During this portion of the exercise, the lifter's muscles progressively shorten or experience concentric contraction. Next, referring to FIGS. 3*b* and 4*a*, the lifter will relax his muscles somewhat to lower the bar, causing a net downward force 60 (FIG. 4*a*) to act on the bar while the lifter's muscles progressively lengthen or experience eccentric contraction. Referring to FIGS. 4*a* and 4*b*, unless this net downward force 60 is varied, the weighted bar 16 will fall with increasing speed until the weighted bar 16 engages the receiving end 54 of the lift assembly 14. In response to further downward movement of the weighted bar, the resilient spring 42 inside the lift assembly generates a dynamic or progressively-increasing lift-restoring force 66 which opposes further downward movement of the weighted bar, as shown in FIGS. 4*c–d*. The maximum level of lift-restoring force 66 in FIG. 4*d* is relatively larger than the net downward force 60 because at the point where the lift-restoring force 66 exactly balances the net downward force 60 (FIG. 4*c*) the weighted bar 16 still has a certain downward velocity or level of kinetic energy that remains to be absorbed in spring 42. Comparing FIGS. 4*c*, 4*d* and 4*e*, the lift-restoring force 66 is maximized at that point in the exercise when the lifter's muscles are weakest, that is, where the lifter's muscles change over from lengthening or eccentric contraction to shortening or concentric contraction. It will also be recognized that the lift-restoring force 66 always acts so as to assist the lifter and never to oppose the lifter. As a result, muscle tearing injuries are not likely to occur with applicant's device.

Referring to FIGS. 4*d–f*, with the help of the lift-restoring force 66, the weighted bar 16 is pushed back, in rebounding movement, from the lifter. The upward velocity of the bar progressively increases in FIGS. 4*e* and 4*f* as potential energy stored in the spring 42 is transferred back to the bar in the form of kinetic energy until finally the weighted bar 16 "explosively" springs away from or is ballistically launched from the receiving end 54 of the lift assembly 14, as shown in FIG. 4*g*. This explosive rebounding movement of the weighted bar against the lift assembly 14 helps to develop the explosive sports-specific muscle power of the lifter.

Referring to FIGS. 4*f–h*, during the launched portion of the movement of the weighted bar 16, the receiving end 54 of the lift assembly withdraws or separates from the weighted bar 16 because spring-engaging clips 44 and 46 are drawn together as the spring 42 over extends. The upward travel of the weighted bar 16 will slow until the weighted bar finally is fully extended (FIG. 4*i*). Meanwhile, the receiving end 54 of the lift assembly 14 is repositioned by the spring element 42, as shown in FIGS. 4*h–i*, so that the entire sequence shown in FIG. 4 can be repeated any desired number of times.

As the lifter performs a number of repetitions with the weighted bar, gradually his muscle strength declines. An important feature of the described lift assembly 14 is that the lifter can increase the maximum level of the lift-restoring force 66 to compensate for the weakening capacity of his own muscles. Referring to FIGS. 4*b–d*, the maximum level of the lift-restoring force 66 is related to the potential energy stored in the spring during maximum compression, which in turn is related to the kinetic energy of the weighted bar 16 when it first engages the receiving end 54 of the lift assembly 14. In other words, by allowing the weighted bar to drop with increased velocity on the lift assembly 14, the lifter will increase the maximum level of lift-restoring force and will receive increased assistance in raising the bar.

If, at any point during the exercise, the lifter should collapse or become unconscious, the weighted bar 16 will drop harmlessly on the lift assembly 14 with a cushioned, rather than jarring, force.

Figure 5:
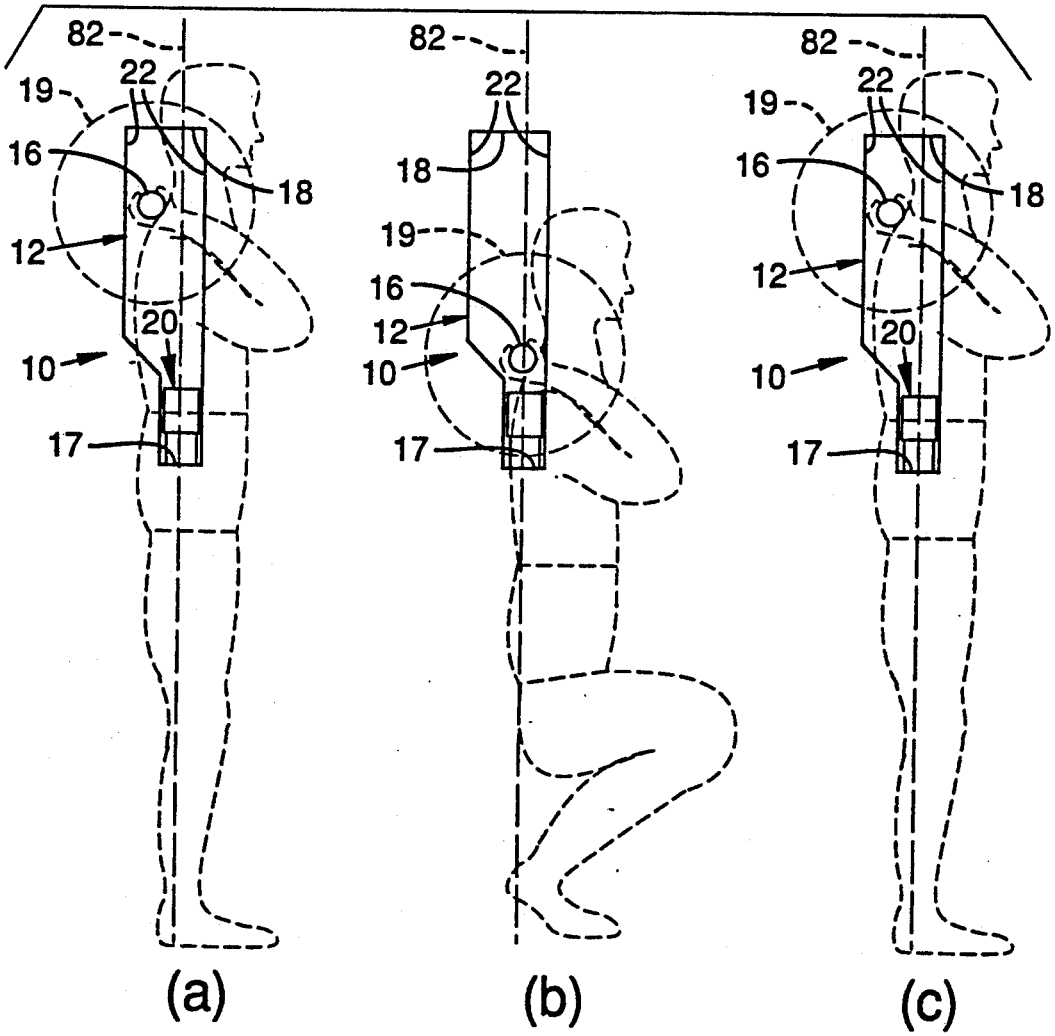

Referring to FIG. 5, the members 10 of the exercise device may also be used to develop explosive muscle power in the legs such as through a squatting exercise. Viewing FIGS. 5*a* and 5*b* together, it will be seen that the narrow channel 20 formed in the lower support portion 17 of the bracket 12 forces the bar to be centered, at the bottom of the squat, along a substantially vertical direction 82 so that the form of the lifter is corrected at the bottom of every repetition. Conversely, as the lifter straightens his leg muscles, guide members 22 of the bracket 12, being spaced apart a distance which is wider than at channel 20, permit the natural springing movement of the muscles to carry the bar rearwardly as well as upwardly. As shown in FIG. 5*c*, when the weighted bar 16 is in the upper widened loop portion 18 of the bracket 12, between guide members 22, the bar is freely maneuverable by the lifter in multiple mutually perpendicular directions. Because the left-hand and right-hand members of the bracket 12 surround the respective end portions of the bar, the bar cannot swing out of control and injure the lifter, other lifters, or the equipment.

Figure 6:
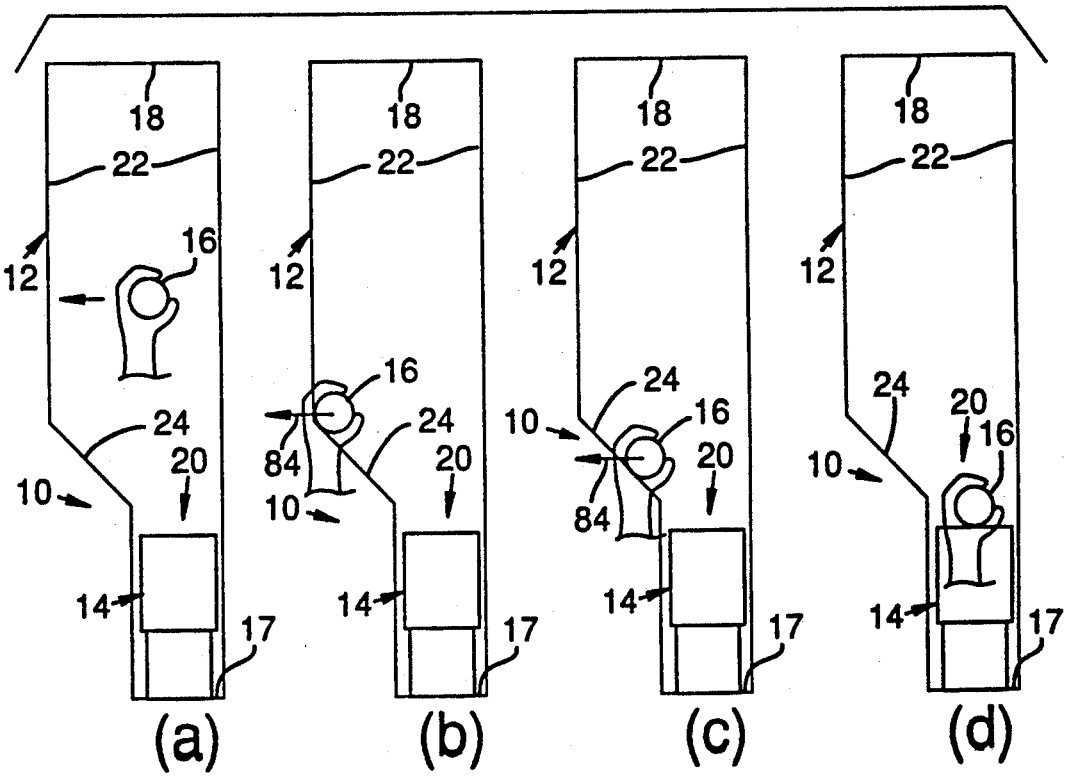

Referring generally to FIGS. 6*a–d*, the ramp surface 24 lying adjacent to and inclined downwardly toward the channel 20 provides a mechanism for the lifter to spot himself, without outside assistance. Referring to FIGS. 6*a–b*, if management of the bar becomes difficult, the lifter maneuvers the weighted bar 16 over towards the ramp surface 24 and presses the bar against the ramp surface with a sideways force 84. Referring to FIGS. 6*c–d*, by regulating the amount of sideways force 84, the lifter controls the rate of movement of the weighted bar toward the channel 20 until, proximate the mouth of the channel, the bar is released and gently lands on lift assembly 14.

Referring to FIG. 7, the weighted bar 16 experiences a downward force 86 equal to the sum of the downward gravitational force and the upward force exerted by the lifter's "prime mover" muscles. The ramp surface 24 permits the lifter to also use his "bracing" muscles to control movement of the weighted bar. The sideways force 84 exerted by the lifter's bracing muscles establishes an upward force component 88 that can balance the downward force component 90 of the downward force 86. This effect makes self-spotting possible even though the lifter's prime mover muscles are unable to vertically raise or even support the bar.

While a preferred embodiment of the invention has been described, it will be recognized that alternative forms of the invention are possible within the broader principles of the present invention. For example, the bracket 12 could be made to move along the strut by means of a worm gear to allow convenient electronic adjustment of the bracket height. The bracket 12 and the lift assembly 14 can, of course, be used independently of each other. However, if the bracket is used without the lift assembly, it would be appropriate to locate the ramp surface 24 closer to the bridge member 32 of the lower support portion 17 because of the absence of cushioning. Alternative embodiments of the lift assembly 14 could feature a pair of springs each coiled about and attached to a respective leg of the generally U-shaped lower support portion 17 with a receiving platform extending across the upper ends of the springs.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A device for assisting a lifter during exercise with a weighted bar having an opposed pair of end portions comprising:

(a) a pair of load-bearing supports;

(b) a pair of brackets each mounted on one of said supports, each bracket being adapted to enclose a respective end portion of the bar;

(c) each bracket including a lower portion defining a channel;

(d) resilient lift means arranged within each of said channels for providing a dynamic lift-restoring force in response to the downward movement of said respective end portions of the bar; and (e) each bracket further including a pair of upright guide members wherein at least one of said upright guide members include a ramp surface adjacent to and inclined toward said channel.

2. The device of claim 1 wherein said lower portion defines a narrow channel for limiting movement of the bar to a substantially vertical direction.

3. The device of claim 1 wherein said resilient lift means includes a receiving end for selectively receiving the bar and limit means for separating the bar from said receiving end during a portion of upward movement of the bar.

4. The device of claim 1 wherein said resilient lift means includes spring means for compressibly opposing downward movement of the bar.

5. The device of claim 1 wherein said resilient lift means includes a reciprocally-guided spring-operated lift assembly.

* * * * *

UNITED STATES PATENT AND TRADEMARK OFFICE

CERTIFICATE OF CORRECTION

PATENT NO. : 5,162,031

DATED : November 10, 1992

INVENTOR(S) : Douglas E. Watson

It is certified that error appears in the above-identified patent and that said Letters Patent is hereby corrected as shown below:

Column 2, line 9, delete (second occurrence of) "MoCreery" and insert --McCreery--.

Column 3, line 31, break for new paragraph beginning with --FIGS. 6a-6d--.

Signed and Sealed this

Twenty-sixth Day of October, 1993

*Attest:*

*Attesting Officer*

Bruce Lehman

BRUCE LEHMAN

*Commissioner of Patents and Trademarks*